US007155768B2

(12) United States Patent
Morita et al.

(10) Patent No.: US 7,155,768 B2
(45) Date of Patent: Jan. 2, 2007

(54) ELECTRIC-MOTORED FLOOR-SURFACE POLISHER

(75) Inventors: Isao Morita, Osaka (JP); Yasuhiro Ueda, Osaka (JP)

(73) Assignee: Penguin Wax Co., Ltd., Osaka (JP)

( * ) Notice: Subject to any disclaimer, the term of this patent is extended or adjusted under 35 U.S.C. 154(b) by 594 days.

(21) Appl. No.: 10/640,943

(22) Filed: Aug. 13, 2003

(65) Prior Publication Data

US 2004/0034954 A1 Feb. 26, 2004

(30) Foreign Application Priority Data

Aug. 20, 2002 (JP) ..... 2002-239352

(51) Int. Cl.
*A47L 11/12* (2006.01)

(52) U.S. Cl. ..... 15/98; 15/52.2; 15/49.1; 451/351

(58) Field of Classification Search ..... 15/98, 15/52.2, 22.1, 50.2, 97.1, 22.2, 81, 380, 49.1; 451/351

See application file for complete search history.

(56) References Cited

U.S. PATENT DOCUMENTS

| | | | | |
|---|---|---|---|---|
| 858,940 | A * | 7/1907 | Bacon | 15/77 |
| 2,247,993 | A * | 7/1941 | Fisker | 15/98 |
| 5,341,536 | A * | 8/1994 | Hill | 15/98 |
| 5,511,271 | A * | 4/1996 | Shishido et al. | 15/49.1 |

FOREIGN PATENT DOCUMENTS

| | | |
|---|---|---|
| CH | 265461 | 12/1949 |
| JP | 35-6288 | 4/1935 |
| JP | 07-039506 | 2/1995 |
| JP | 09-201321 A | 5/1997 |

* cited by examiner

*Primary Examiner*—Gary K. Graham
(74) *Attorney, Agent, or Firm*—Townsend and Townsend and Crew LLP

(57) ABSTRACT

An electric-motored floor-surface polisher includes a pair of pads juxtaposed in the front and rear or lateral direction of an apparatus frame, each pad being slidably supported to the apparatus frame. A drive pulley coupled to an output shaft of an electric motor to be rotated therewith. The polisher includes a pair of pad driving members, each pad driving member having an input pulley portion operably coupled with the drive pulley via a toothed belt and having also an output portion provided at a portion of the driving member offset from a rotational axis of the input pulley portion to be rotatable therewith and a pair of pad operating rods, one of the pair of pad operating rods having one end thereof pivotally coupled with the output portion of one of the pair of pad driving members and the other end thereof pivotally coupled with the one of the pair of pads and the other pad operating rod having one end thereof pivotally coupled with the output portion of the other pad driving member and the other end thereof pivotally coupled with the other pad. With this, the pair of pad operating rods slidably reciprocate the pair of pads along the juxtaposing direction thereof and in directions opposite to each other.

2 Claims, 8 Drawing Sheets

ELECTRIC-MOTORED FLOOR-SURFACE POLISHER

TECHNICAL FIELD

The present invention relates to an electric-motored floor-surface polisher including an electric motor and a pad driven by the motor to act on a floor surface.

BACKGROUND ART

When a pad is rotatably driven to act on a floor surface, there occurs a difference in the peripheral speed between the center portion and the outer peripheral portion of the pad. For this reason, even if the pad acts on the floor surface at an appropriate speed in its outer peripheral portion, the pad fails to provide sufficient polishing effect at the center portion thereof. Especially, such insufficient or irregular work would occur more likely when the pad is formed large to provide an increased working area. On the other hand, if the pad is driven to effect a reciprocal movement relative to the floor surface, such pad can act on the floor surface at an equal speed over the entire face thereof. Then, even if this pad is formed large, such insufficient or irregular work will less likely to occur even for the enlarged working area of the pad.

As such apparatus having a pad which is reciprocated relative to the floor surface is known from e.g. Japanese Utility Model "Kokoku" No.: Sho. 35-6288 (referred to as "prior art 1", hereinafter) and Japanese Patent Application "Kokai" No.: Hei. 7-39506 (referred to as "prior art 2" hereinafter).

The prior art 1 discloses a construction in which each of a pair of pads is supported to be movable along a guide dovetail groove and a small gear is meshed with a large gear coupled with one pad via a rod and with a large gear coupled with the other pad via a rod. A worm gear is meshed with this small gear, so that as a worm member meshed with the worm gear is driven by an electric motor, each large gear is driven, whereby the respective rods are reciprocated by the rotational drive from the large gears, thus reciprocating the respective pads. With this driving technique, the pair of pads are driven to be reciprocated with one pad being advanced and the other being retracted along a direction normal to the juxtaposing direction of the pads. For this reason, there would tend to generate a reaction force from the floor surface which force tends to causes rotational displacement of the apparatus frame. Also, since the power transmission is effected by means of meshing of the gears, a large drive noise would be generated.

The prior art 2 discloses a construction in which each of a pair of pads is coupled to a mount frame via two anti-vibration rubber elements and to one ends of these anti-vibration rubber elements, vibration plates are connected and the other ends of the vibration plates are attached to an eccentric shaft. As this eccentric shaft is driven by a motor for reciprocating the respective vibration plates, the vibration plates drive and reciprocate the pads via the anti-vibration rubber elements as the pivots. With this driving technique, since the pads are pivoted via the anti-vibration rubber elements as the pivots, there would occur vibrations such as vertical vibrations of the pads. Further, if the moving stroke of the pad is to be increased, this will necessitate increase in the deformation amount at the pivot. However, with such large deformation at the pivot, there will occur resistance against the movement of the pivot due to the load for pressing the pad against the floor surface. As a result, a driving problem or failure would tend to occur. In view of this, it was actually not possible to secure such a large movement stroke for the pad.

Therefore, a primary object of the present invention is to provide an electric-motored floor-surface polisher whose pad can act on the entire floor surface at an equal speed and on a maximum area of the floor surface and which yet can reduce occurrence of a reaction force from the floor surface or vibration of the apparatus frame due to the driving and generation of noise.

DISCLOSURE OF THE INVENTION

For accomplishing the above-noted object, according to the characterizing feature of claim 1, there is provided an electric-motored floor-surface polisher comprising:

a pair of pads juxtaposed in the front and rear or lateral direction of an apparatus frame, each pad being slidably supported to the apparatus frame;

a drive pulley coupled to an output shaft of an electric motor to be rotated therewith;

a pair of pad driving members, each pad driving member having an input pulley portion operably coupled with said drive pulley via a toothed belt and having also an output portion provided at a portion of the driving member offset from a rotational axis of the input pulley portion to be rotatable therewith; and a pair of pad operating rods, one of the pair of pad operating rods having one end thereof pivotally coupled with the output portion of one of the pair of pad driving members and the other end thereof pivotally coupled with the one of the pair of pads and the other pad operating rod having one end thereof pivotally coupled with the output portion of the other pad driving member and the other end thereof pivotally coupled with the other pad;

whereby the pair of pad operating rods slidably reciprocating the pair of pads along the juxtaposing direction thereof and in directions opposite to each other.

With the above-described construction, the electric motor drives the drive pulley and the drive force of this drive pulley is transmitted to the input pulley portion of one pad driving member via the toothed belt, thereby to reciprocate one pad operating rod, which in turn reciprocates the one pad. Also, the drive force of the drive pulley is transmitted via the toothed belt also to the input pulley portion of the other pad driving member, thereby to reciprocate the other pad operating rod, which in turn reciprocates the other pad. In this, the pair of pad operating rods reciprocate the pair of pads along the juxtaposing direction thereof and in directions opposite to each other.

According to the above, the drive force of the electric motor can be transmitted via the toothed belts to the pair of pad driving members without slipping thereof and the pair of pads can be driven at appropriate timing so that the pair of pads can be slidably reciprocated along the juxtaposing direction and in the opposite directions. Also, the pads can act on the floor surface at an equal speed over the entire area of the floor and reaction forces acting on the respective pads from the floor surface can be effectively offset each other. As a result, the pads can be driven with generating less vibration of the apparatus frame due to the reaction forces.

According to one conceivable construction, the drive force of the electric motor could be transmitted to the pad driving members via a gear mechanism for reciprocating the pad operating rods. According to a further conceivable construction, each pad driving member includes a pad driving portion projecting from a portion thereof offset from the rotational axis thereof, while each pad includes an operational groove in which the pad driving portion slidable engages, the operational groove being provided as an elongate groove extending along a direction normal to the sliding direction of the pad. With these conceivable constructions too, the pair of pads can be reciprocated along the juxtaposing direction thereof and in the opposite directions and without any drive timing errors of the pads. However, with these conceivable constructions, the driving noise tends to be generated due to the meshing of the gears or the slidable contact with the transmitting members between the electric motor and the pad driving members and/or pad driving members and the pads.

On the other hand, according to the present invention relating to claim 1, the drive pulley and the pad driving members are coupled with each other via the toothed belts and the pad operating rods are pivotally coupled with the pads. Hence, the pads can be reciprocated with restricting driving noise and without causing any driving timing error between the pads.

In addition, since each pad is driven and reciprocated with the pad being slidably supported to the apparatus frame, the reciprocating movement of the pad can take place with restricting its vibration, especially its vertical vibration. For this reason, even if a large movement stroke is secured for the pad and a large load is applied to the pad for pressing it against the floor surface, the reciprocating movement of the pad can take place smoothly without driving problem or failure thereof.

On the other hand, if the output of the electric motor is high speed and this high speed output is transmitted as it is to the pad operating rods without speed adjustment thereof, this will cause inappropriate high-speed reciprocation of the pads relative to the floor surface. In such case too, according to the above-described construction, the driving speed of the electric motor can be readily adjusted by adjusting a transmission ratio between the drive pulley and each pad driving member, so that each pad can be reciprocated at an appropriate speed to act on the floor surface.

According to the characterizing feature of the present invention relating to claim 2, in the construction of the invention relating to claim 1, the pair of pad driving members are disposed, relative to the drive pulley, on a side opposite to or away from the side where the pads operatively coupled to the pad operating rods are located.

The pad operating rod functions to slidably operate the pad while the rod is pivoted about the coupling axis to the pad. And, as the pad driving member is located on the opposite side to the side of the pad relative to the drive pulley, the coupled posture of the pad operating rod is not. greatly inclined relative to the pad. For this reason, with the above-described construction, the pad can be slidably operated without much "twist" or distortion between the pad and the member slidably supporting this pad.

According to the characterizing feature of the invention relating to claim 3, there is provided an electric-motored floor-surface polisher comprising:

a pair of pads juxtaposed in the front and rear or lateral direction of an apparatus frame, each pad being slidably supported to the apparatus frame;

a pair of eccentric rotary cams coupled to an output shaft of an electric motor to be rotated therewith; and a pair of pad operating rods, one of the pair of pad operating rods having one end thereof pivotally fitted on one of the pair of eccentric rotary cams and the other end thereof pivotally coupled with the one of the pair of pads so that the one pad is reciprocated by a rotation force of the one eccentric rotary cam, and the other pad operating rod having one end thereof pivotally fitted on the other eccentric rotary cam and the other end thereof pivotally coupled with the other pad so that the other pad is reciprocated by a rotation force of the other eccentric rotary cam;

whereby the pair of pad operating rods slidably reciprocating the pair of pads along the juxtaposing direction thereof and in directions opposite to each other.

With the above-described construction, as the electric motor drives the pair of eccentric rotary cams, one of the pad operating rods is reciprocated by the rotation force of the one eccentric rotary cam thereby to reciprocate one pad while the other pad operating rod is reciprocated by the rotation force of the other eccentric rotary cam thereby to reciprocate the other pad. In this, the pair of pad operating rods reciprocate the pair of pads along the juxtaposing direction thereof and in directions opposite to each other.

According to the above, the drive force of the electric motor can be transmitted to the pair of pad operating rods without slipping thereof and the pair of pads can be driven at appropriate timing so that the pair of pads can be slidably reciprocated along the juxtaposing direction and in the opposite directions. Also, the pads can act on the floor surface at an equal speed over the entire area of the floor and reaction forces acting on the respective pads from the floor surface can be effectively offset each other. As a result, the pads can be driven with generating less vibration of the apparatus frame due to the reaction forces.

According to one conceivable construction, the drive force of the electric motor could be transmitted via a gear mechanism for reciprocating the pad operating rods. According to a further conceivable construction, a rotary member rotatable by an electric motor includes a pad driving portion projecting from a portion thereof offset from the rotational axis thereof, while each pad includes an operational groove in which the pad driving portion slidable engages, the operational groove being provided as an elongate groove extending along a direction normal to the sliding direction of the pad. With these conceivable constructions too, the pair of pads can be reciprocated along the juxtaposing direction thereof and in the opposite directions and without any drive timing errors of the pads. However, with these conceivable constructions, the driving noise tends to be generated due to the meshing of the gears or the slidable contact with the transmitting members between the electric motor and the pad operating rods and/or the rotary drive members and the pads.

On the other hand, according to the present invention relating to claim 3, the pad operating rod is pivotally coupled to both the eccentric rotary cam and the pad. Hence, the pads can be reciprocated with restricting driving noise and without causing any driving timing error between the pads.

In addition, since each pad is driven and reciprocated with the pad being slidably supported to the apparatus frame, the reciprocating movement of the pad can take place with restricting its vibration, especially its vertical vibration. For this reason, even if a large movement stroke is secured for the pad and a large load is applied to the pad for pressing it against the floor surface, the reciprocating movement of the pad can take place smoothly without driving problem or failure thereof.

According to the characterizing feature of the invention relating to claim 1 or 3, the pad, even if formed large to have an increased working area, can act on the floor surface over the entire area thereof and at an equal speed. In addition, even if the moving stroke of the pad is increased, the pad can still be driven smoothly and efficiently, thus achieving efficient operation providing good finish while restricting occurrence of such problem as leaving any floor portion unpolished. And, the reaction forces acting on the pair of pads are effectively offset each other, thus causing less vibration in the apparatus frame, and with the reduced vibration in the pads, generation of driving noise can be effectively restricted. As a result, the apparatus can operate silently. Moreover, even if the apparatus is constructed as a hand-propelled type, the apparatus will less likely "jump" up against the floor surface and the apparatus can be operated comfortably and easily even when the apparatus is supported only lightly by the operator's hands.

According to the characterizing feature of the invention relating to claim 2, distortion or twist between the pad and its supporting member is less likely to occur and the pad can be driven and reciprocated smoothly. In this case too, generation of vibration or noise can be effectively reduced and the apparatus can be operated quietly and comfortably.

Further and other features and advantages of the invention will become apparent upon reading the following detailed description of the preferred embodiments thereof with reference to the accompanying drawings.

BEST MODE OF EMBODYING THE INVENTION

Next, modes of embodying the present invention will be described with reference to the accompanying drawings.

[First Embodiment]

Figure 1:
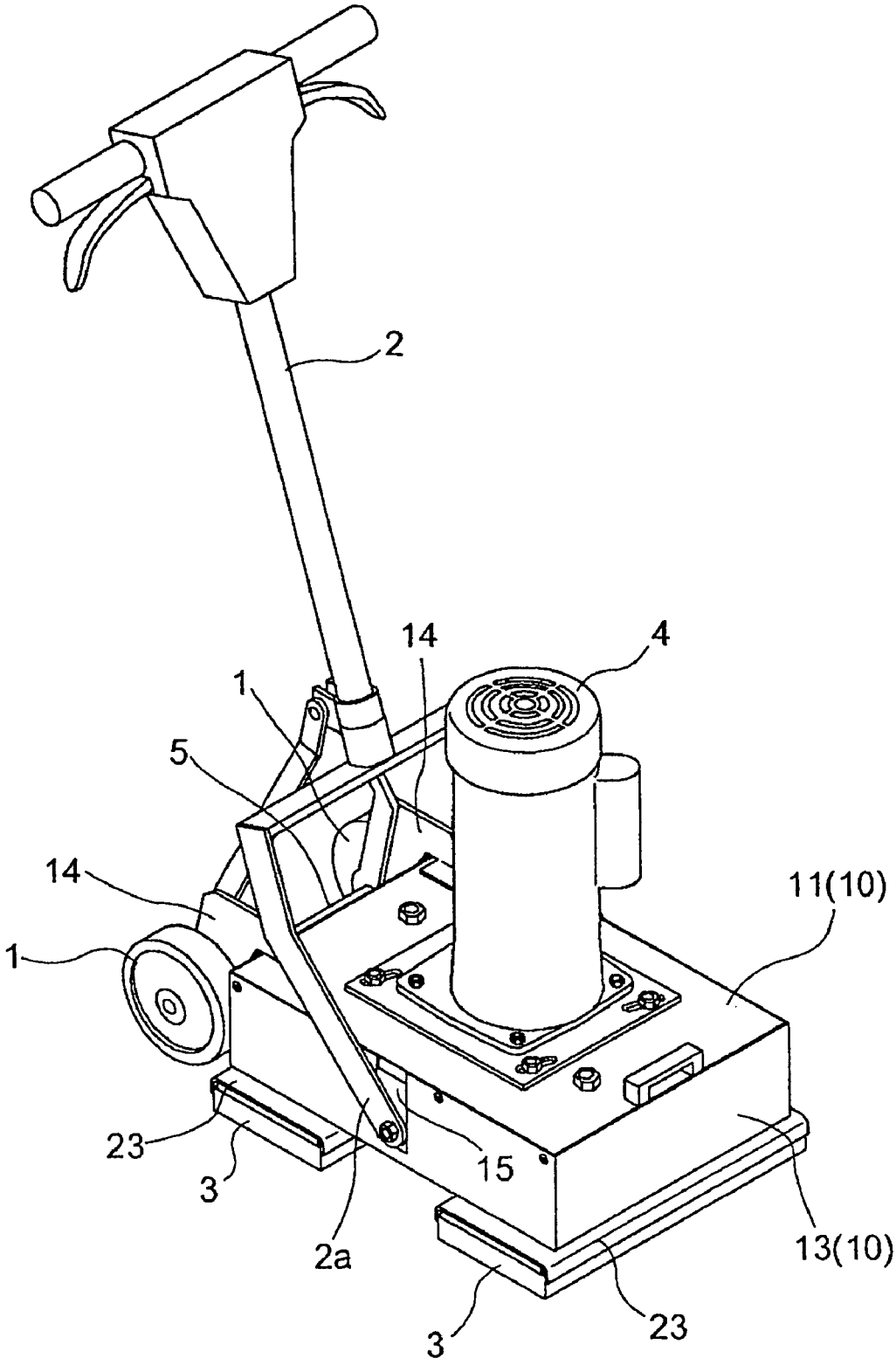
FIG. 1 is a perspective view showing an entire electric-motored floor-surface polisher.

As shown in FIG. 1, a hand-propelled compact electric-motored floor-surface polisher includes a pair of right and left free-rotation wheels 1, a machine frame 10 including a steering handle 2, a pair of pads 3 provided under the machine frame 10 and juxtaposed in the front and rear direction of the machine frame 10, and an electric motor 4 mounted on the top face of the machine frame 10.

With this polisher, in response to an operation or manipulation of the steering handle 2, the machine frame 10 can be pivoted upward at the front end portion thereof about the axle so as to lift the two pads 3 off the floor surface and under this condition, the machine can be transported to a work site by using the wheels 1. At the work site, the pair of pads 3 will be placed on the floor surface so that the entire load of the polisher may be applied to the pads 3. Under this condition, the pads 3 are driven by the electric motor 4 for polishing the floor surface of the work site. The construction of the polisher will be described in greater details next.

Figure 2:
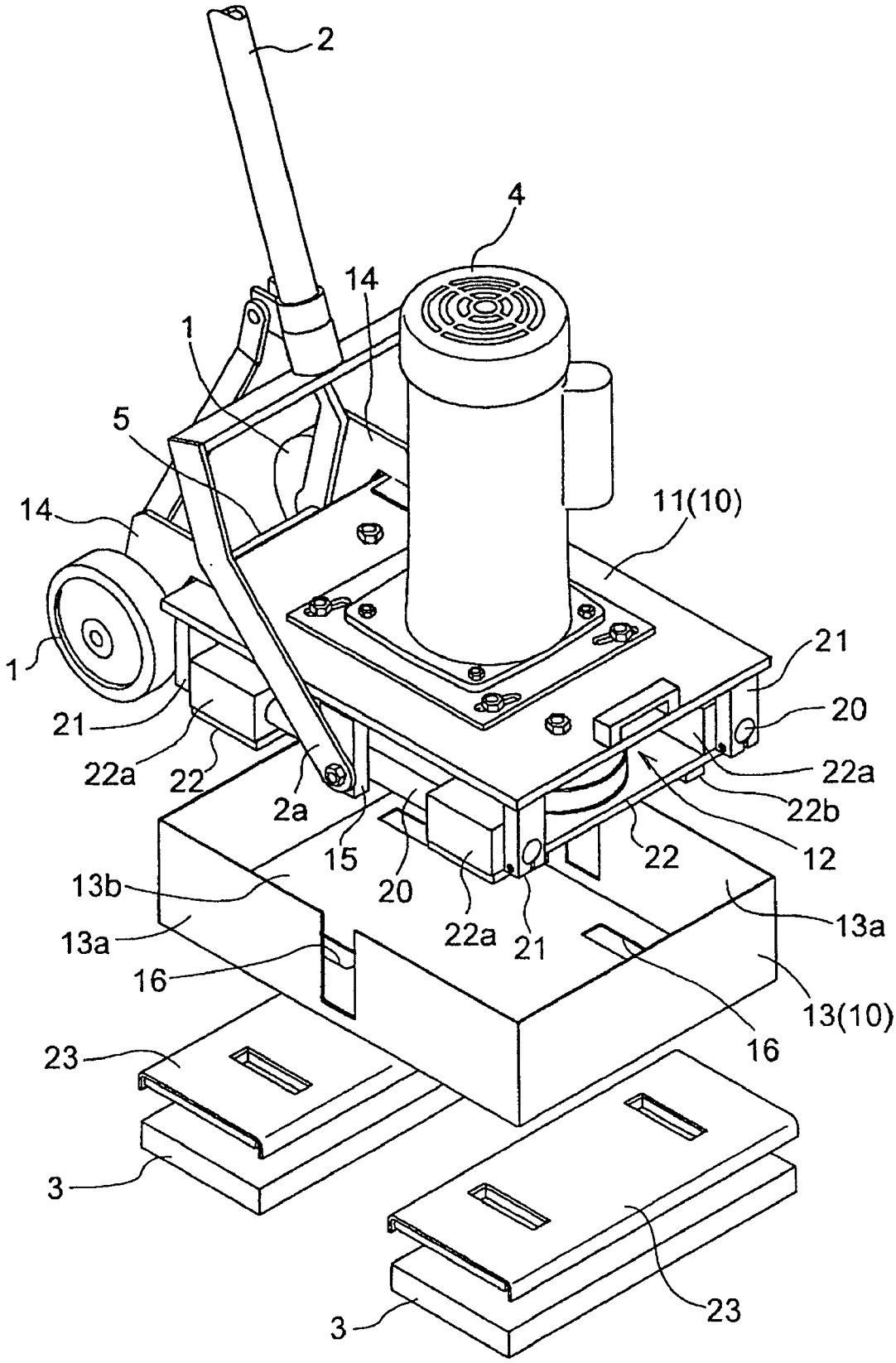
FIG. 2 is a perspective view showing a disassembled condition of a machine frame.

As shown in e.g. FIG. 2, the machine frame 10 consists essentially of a machine frame body 11 formed of a metal plate having a rectangular shape in a plan view and a box-like metal cover member 13 having right and left side plate portions 13*a* whose upper ends are connected to the side ends of the machine frame body 11. The cover member 13 forms a pad driving chamber 12 downwardly of the machine frame body 11 and is detachably attached to the machine frame body 11 by connecting screws.

Figure 3:
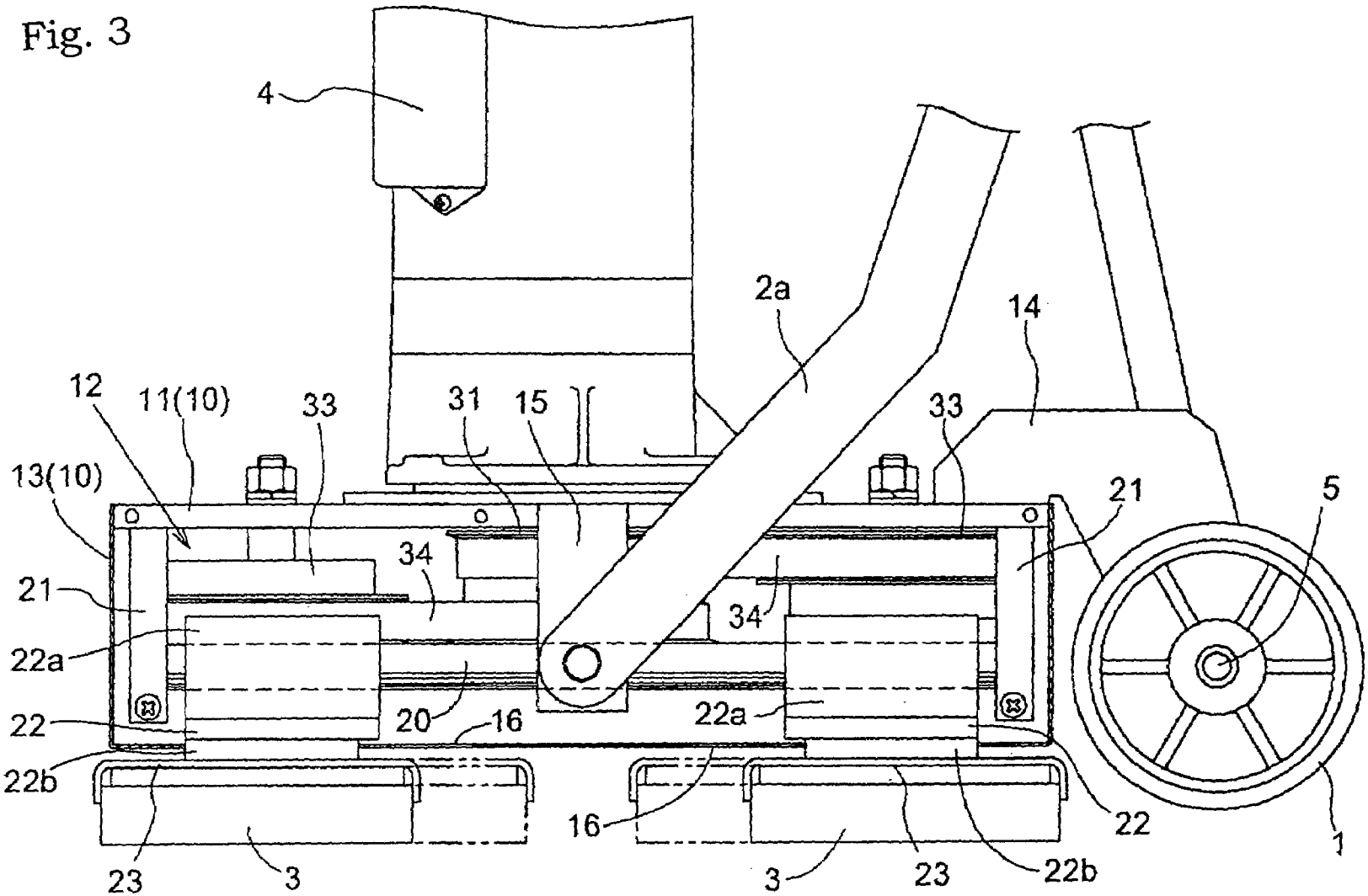
FIG. 3 is a side view showing a pad mounting construction.
Figure 4:
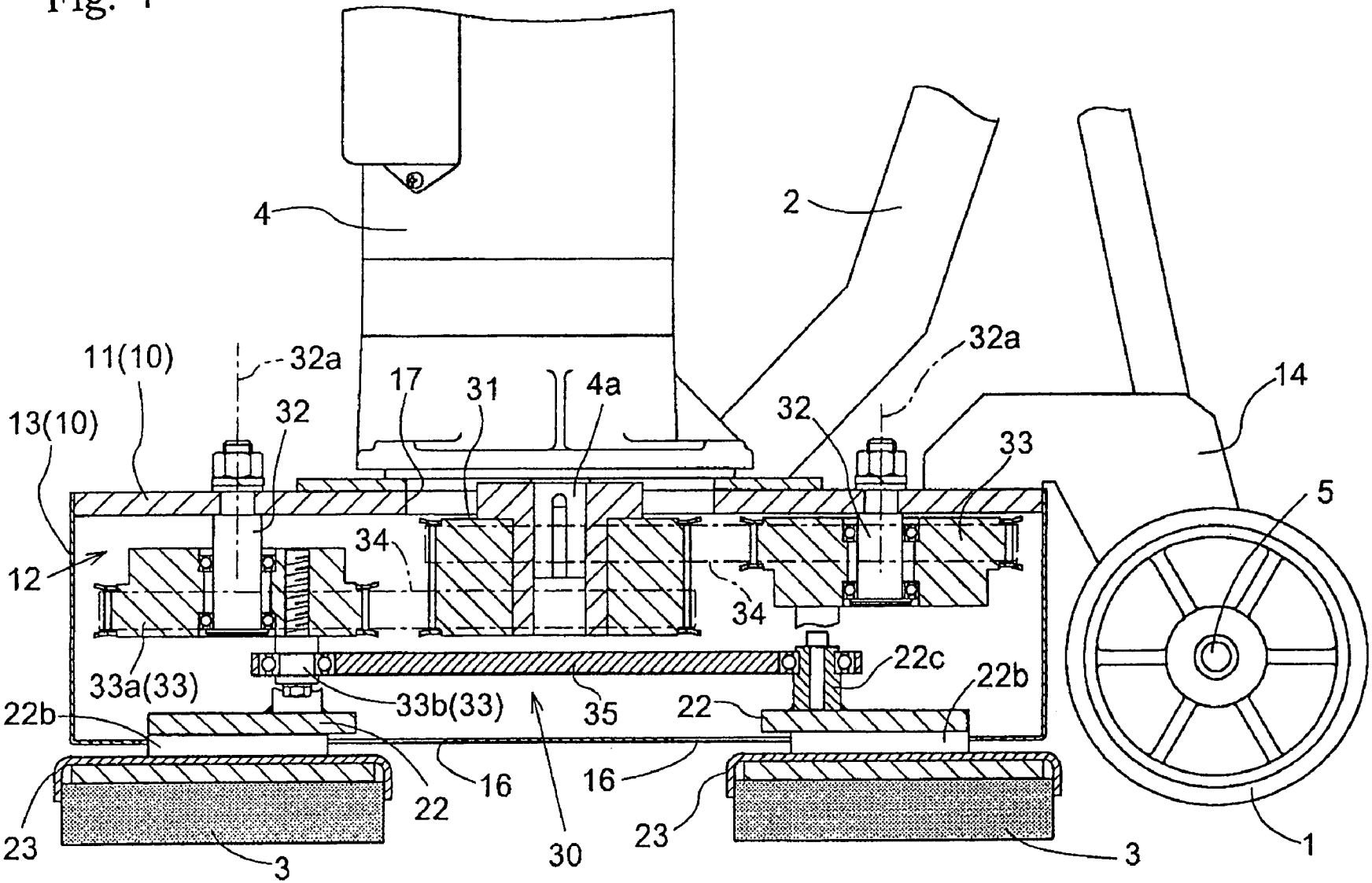
FIG. 4 is a side view showing a pad operating mechanism.

As shown mainly in FIGS. 2 and 3, a single axle 5 is attached between a pair of right and left brackets 14 connected to the top face of the rear end of the machine frame body 11. This axle 5 rotatably mounts the wheels 1 at opposed ends thereof With this, the machine frame 10 rotatably supports the right and left wheels 1.

Further, to the bottom face of front-and-rear intermediate portions of the machine frame body 11, a pair of handle support portions 15 made of metal blocks are connected. And, to these handle support portions 15, a pair of right and left base portions 2*a* of the steering handle 2 are pivotally connected. With this, the machine frame 10 allows angle adjustment of the steering handle 2 about the axis via which the base portions 2*a* are connected to the handle support portions 15.

As shown in FIGS. 3 through 6, to the bottom face of the machine frame body 11, a pair of right and left support rails 20 are attached via a pair of front and rear support blocks 21. The support rails 20 are made of round bars and disposed on the opposed lateral sides of the pad driving chamber 12.

Further, by means of a pair of attaching portions 22*a* slidably fitted on the right and left pair of support rails 20, a front pad support member 22 is slidably attached to forward ends of the pair of support rails 20. And, to the bottom face of this front pad support member 22, a pad holder 23 is detachably attached by means of connecting screws. And, to a pad attaching face of this pad holder 23 provided to the bottom face of the pad holder 23 by means of a surface fastener, the front pad 3 of the pair of front and rear pads 3 is detachably attached.

Similarly, by means of a pair of attaching portions 22*a* slidably fitted on the right and left pair of support rails 20, an rear pad support member 22 is slidably attached to forward ends of the pair of support rails 20. And, to the bottom face of this rear pad support member 22, a further pad holder 23 is detachably attached by means of connecting screws. And, to a pad attaching face of this pad holder 23 provided to the bottom face of the pad holder 23 by means of a surface fastener, the rear pad 3 of the pair of front and rear pads 3 is detachably attached.

Figure 5:
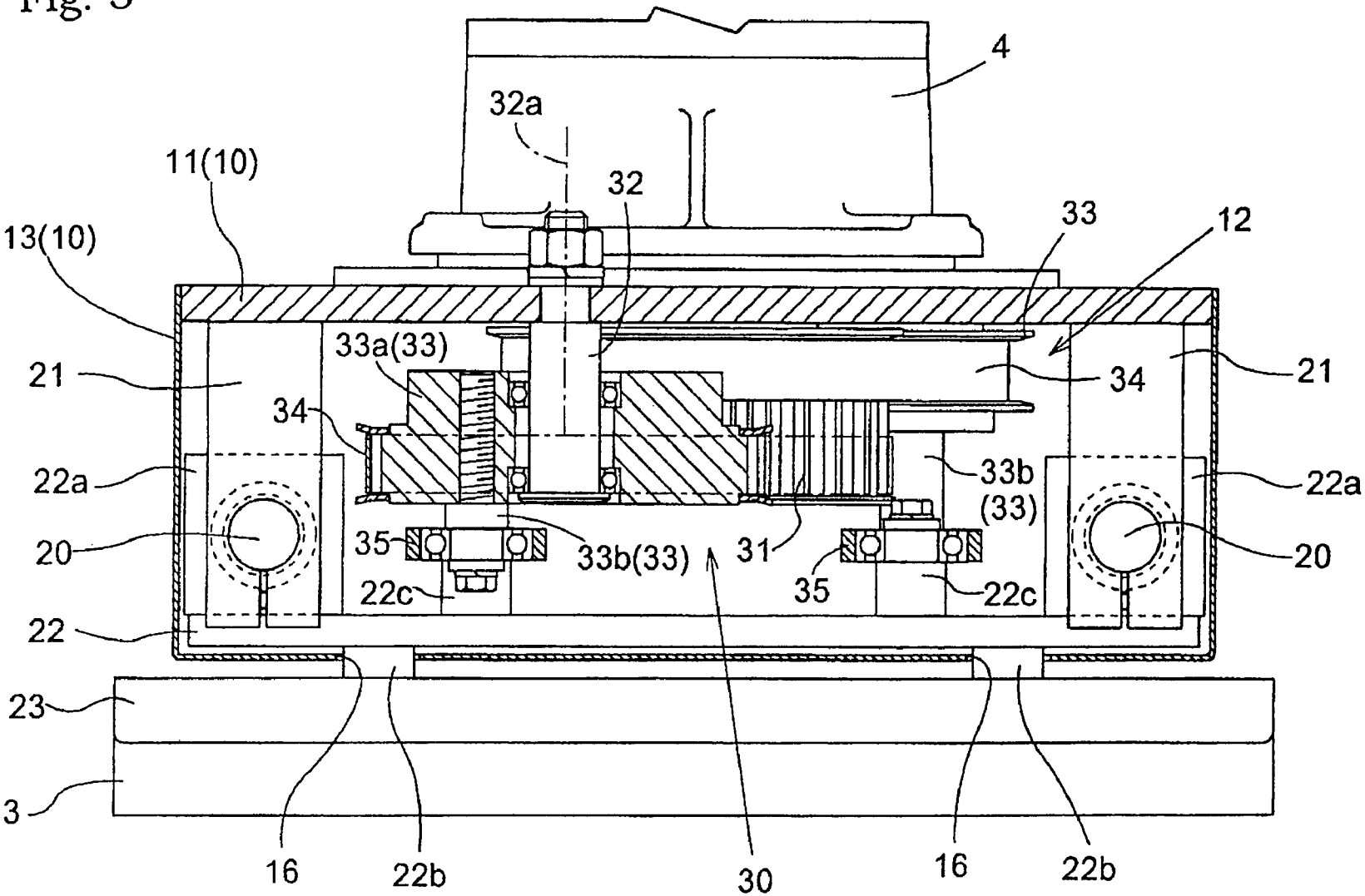
FIG. 5 is a front view of the pad mounting construction and the pad operating mechanism.
Figure 6:
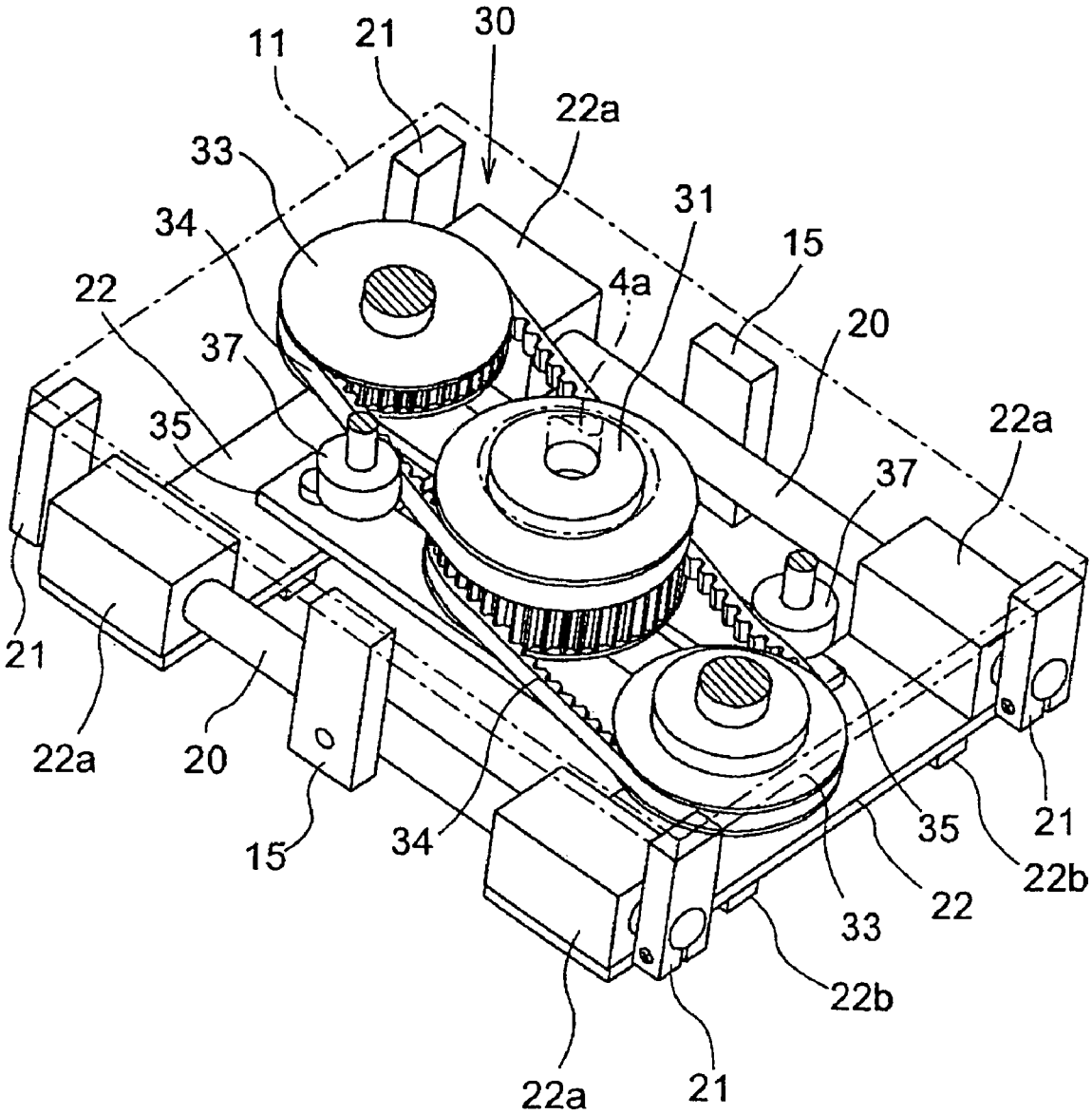
FIG. 6 is a perspective view of the pad operating mechanism.

As shown mainly in FIGS. 3 and 5, each of the front pad holder 23 and the rear pad holder 23 includes a pair of right and left metal members attached to the bottom face of the pad support member 22 and is attached across a pair of right and left attaching seat portions 22*b* projecting downwardly from the bottom face of the pad support member 22. Each attaching seat portion 22*b* projects downwardly of the cover member 13 through a through elongate hole 16 as shown in FIG. 2 defined in a bottom plate 13*b* of the cover member 13 and the seat portion 22*b* is movably engaged within this through elongate hole 16. Accordingly, each of these front pad holder 13 and rear pad holder 23 is located on the outer side of the pad driving chamber 12 and is connected slidable together with the pad support member 22 located on the inner side of the pad driving chamber 12 in the front and rear direction along the support rail 20 relative to the machine frame body 11.

With the above-described arrangements, the front pad 3 and the rear pad 3 are supported by the support portion comprising the pair of right and left support rails 20 of the machine frame 10 to be slidable via the pad support members 22 and the pad holders 23 along the front and rear direction of the machine frame 10, with the front pad 3 and the rear pad 3 being slidable independently of each other.

The pad driving chamber 12 accommodates therein a pad operating mechanism 30. This pad operating mechanism 30, as shown in FIG. 3, FIG. 4, FIG. 6 and FIG. 7, includes a drive pulley 31 rotatably attached to an end of an output shaft 4*a* of the electric motor 4, which end extends through a through hole 17 defined in the machine frame body 11 into the pad driving chamber 12, so that the pulley 31 is rotatable in unison with the output shaft 4*a*.

And, this pad operating mechanism 30 includes an rear pad driving member 33 disposed on the side away from the front pad support member 22 relative to the drive pulley 31 and rotatably attached via a support shaft 32 on the bottom face of the machine frame body 11, a toothed belt 34 operably coupling this rear pad driving member 33 with the drive pulley 31, and a pad operating rod 35 operably coupling the rear pad driving member 33 with the front pad support member 22.

Further, the pad operating mechanism 30 further includes a front pad driving member 33 disposed on the side away from the rear pad support member 22 relative to the drive pulley 31 and rotatably attached via a support shaft 32 on the bottom face of the machine frame body 11, a toothed belt 34 operably coupling this front pad driving member 33 with the drive pulley 31, and a pad operating rod 35 operably coupling the front pad driving member 33 with the rear pad support member 22.

The pad operating mechanism 30 further includes a tension wheel 37 rotatably attached via a support shaft 36 to the bottom face of the machine frame body 11 and adapted for applying a driving tension to each toothed belt 34.

The front pad driving member 33 and the rear pad driving member 33 are constructed as belt pulleys. And, the toothed belt 34 is entrained around an input pulley portion 33*a* provided in each driving member 33 and the drive pulley 31. With this, the drive force of the drive pulley 31 can be transmitted via the toothed belt 34 to the input pulley portion 33*a* without slippage and the input pulley portion 33*a* can be rotated about the axis 32*a* of the support shaft 32.

In order to allow the drive force of the drive pulley 31 to be transmitted at a slightly reduced speed to each pad driving member 33, reduced speed ratios are set as the speed ratio between the drive pulley 31 and the input pulley portion 33*a* of one pad driving member 33 and the speed ratio between the drive pulley 31 and the input pulley portion 33*a* of the other pad driving member 33, respectively.

One end of the pad operating rod 35 coupled with the rear pad driving member 33 is rotatably coupled to an output portion 33*b*. This output portion 33*b* includes a transmission shaft provided at a position offset from the rotational axis 32*a* of the input pulley portion 33*a* and extending parallel with the axis 32*a* and the output portion 33*b* is rotatable in unison with the input pulley portion 33*a* about the axis 32*a*. And, the other end of the pad operating rod 35 on the side of the pad 3 is rotatably coupled with an input portion 22*c* provided by attaching an input shaft on the top face of the front pad support member 22, so as to be pivotable relative to the front pad 3.

One end of the other pad operating rod 35 coupled with the front pad driving member 33 is rotatably coupled to an output portion 33*b*. This output portion 33*b* includes a transmission shaft provided at a position offset from the rotational axis 32*a* of the input pulley portion 33*a* and extending parallel with the axis 32*a* and the output portion 33*b* is rotatable in unison with the input pulley portion 33*a* about the axis 32*a*. And, the other end of the pad operating rod 35 on the side of the pad 3 is rotatably coupled with an input portion 22*c* provided by attaching an input shaft on the top face of the rear pad support member 22, so as to be pivotable relative to the rear pad 3.

Figure 7:
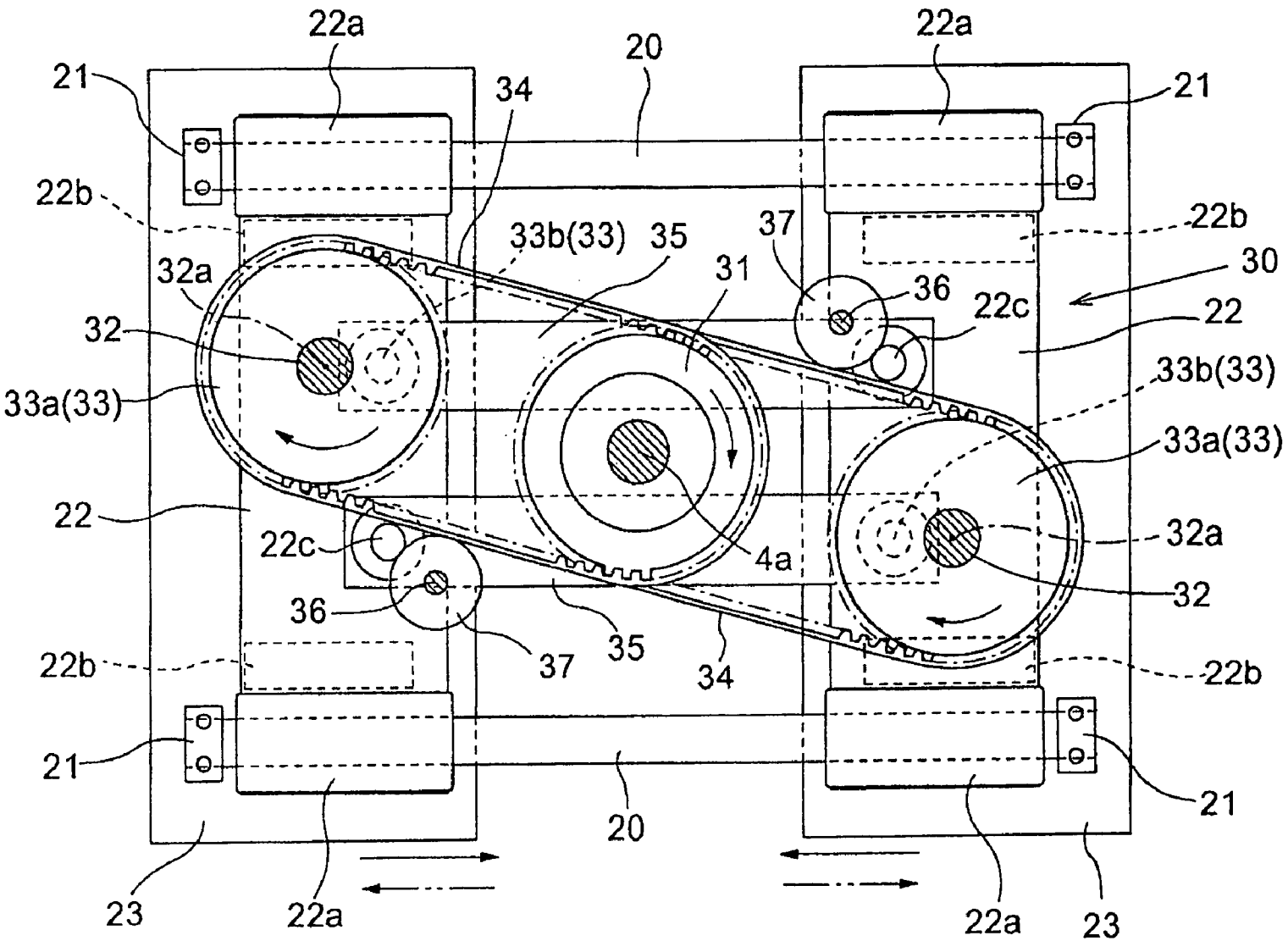
FIG. 7 is a plan view of the pad operating mechanism.

Then, the pair of pad driving members 33 are adapted to be rotatably driven with maintaining a rotational phase relationship relative to each other as shown in FIG. 7. Referring more particularly to this relationship, there axes, namely, an axis 33*b* about which the pad operating rod 35 is pivotally coupled with the front pad driving member 33, the rotation axis 32*a* of this front pad driving member 33 and the axis 22*c* about which this pad operating rod 35 is pivotally coupled with the rear pad support member 22, are aligned along a single straight line and also the axis 33*b* about which the pad operating rod 35 is pivotally coupled with the front pad driving member 33 is located on the side of the rear pad support member 22 relative to the rotation axis 32*a* of the pad driving member 33. In this, the rotational axis 33*b* about which the pad operating rod 35 is pivotally coupled with the rear pad driving member 33, the rotation axis 32*a* of this rear pad driving member 33 and the axis 22*c* about which this pad operating rod 35 is pivotally coupled with the front pad support member 22, are aligned along a single straight line and also the axis 33*b* about which the pad operating rod 35 is pivotally coupled with the rear pad driving member 33 is located on the side of the front pad support member 22 relative to the rotation axis 32*a* of the pad driving member 33. With these arrangements, the pair of pad operating rods 35 are driven to reciprocate by the pad driving members 33, whereby the pair of pads 3 are reciprocated along the support rails 20 along the front and rear direction of the machine 10 and in directions opposite to each other.

With the above-described construction, the pad operating mechanism 30 operates the two pads 3 by the driving force from the motor 4 in the following manner.

Namely, first, the drive pulley 31 is driven about the axis of the motor output shaft 4*a* by the drive force of the electric motor 4. Then, this drive force of the drive pulley 31 is transmitted via one toothed belt 34 to the pulley portion 33*a* of the front pad driving member 33, whereby the pad driving member 33 is driven at a rotational speed reduced from the rotational speed of the drive pulley 31. Further, the drive force of the drive pulley 31 is transmitted via the other toothed belt 34 to the pulley portion 33*a* of the rear pad driving member 33, whereby this pad driving member 33 is driven at a rotational speed reduced from the rotational speed of the drive pulley 31.

With the above, the one pad operating rod 35 is reciprocated by the output portion 33*b* of the front pad driving member 33, so that this pad operating rod 35 can slidably reciprocate the rear pad 3 along the support rail 20 in the front and rear direction of the machine frame 10. Further, the other pad operating rod 35 is reciprocated by the output portion 33*b* of the rear pad driving member 33, so that this pad operating rod 35 can slidably reciprocate the front pad 3 along the support rail 20 in the front and rear direction of the machine frame 10.

And, as the pair of pad driving members 33 are driven with maintaining the above-described rotational phase relationship relative to each other, the pair of pad operating rods 35 reciprocate the pair of pads 3 along the front and rear direction of the machine frame which corresponds to the juxtaposing direction of these pads 3 and in the directions opposite from each other, so as to effectively cancel out each other the reaction forces applied to the two pads 3 from the floor surface.

[Second Embodiment]

Figure 8:
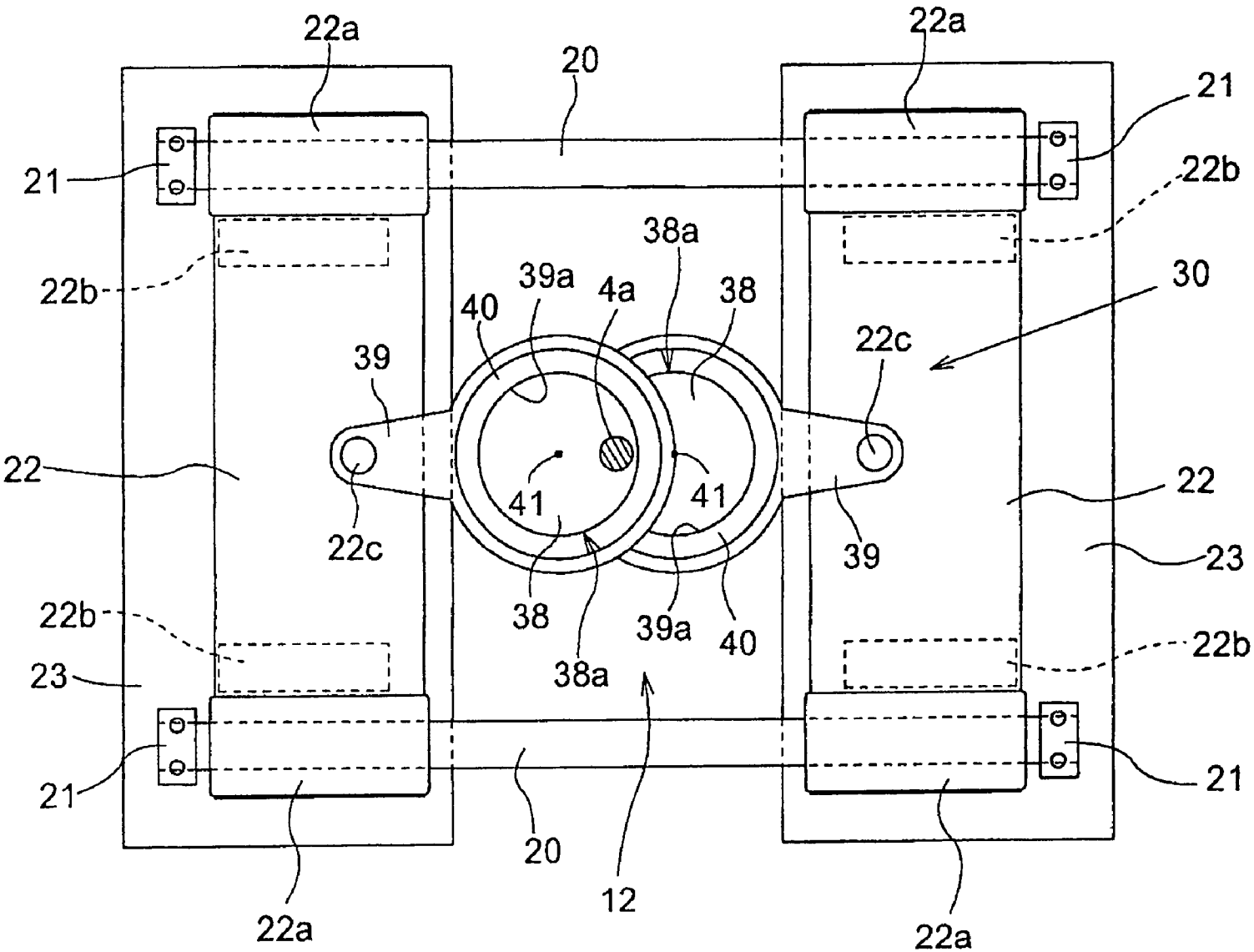
FIG. 8 is a plan view of a pad operating mechanism of an electric-motored floor-surface polisher relating to a second embodiment of the invention.

FIG. 8 shows a pad operating mechanism 30 employed in an electric-motored floor-surface polisher relating to the second embodiment of the present invention. This electric-motored floor-surface polisher includes the same machine frame 10 and the same pad mounting construction as employed in the above-described polisher relating to the first embodiment and differs therefrom only in the pad operating mechanism 30. Therefore, only this pad operating mechanism 30 will be described next.

The pad operating mechanism 30 employed in the polisher relating to this second embodiment includes a pair of upper and lower eccentric rotary cams 38 rotatably attached to an end of the output shaft 4*a* of the electric motor 4 which end extends into the pad driving chamber 12, a pad operating rod 39 connecting between one of the pair of upper and lower eccentric rotary cams 38 and the front pad support member 22 and a further pad operating rod 39 connecting between the other of the pair of upper and lower eccentric rotary cams 38 and the rear pad support member 22.

The one end of the pad operating rod 39 coupled with one of the pair of upper and lower eccentric rotary cams 38 on the side of the cam 38 is rotatably fitted on this eccentric rotary cam 38 via a connecting hole 39*a* having a metal bearing 40 provided at this end. The other end of the rod 39 on the side of the pad 3 is pivotally coupled with the input portion 22*c* provided by attaching the input shaft on the top face of the front pad support member 22, whereby this end is pivotally coupled with the front pad 3.

The one end of the other pad operating rod 39 coupled with the other of the pair of upper and lower eccentric rotary cams 38 on the side of the cam 38 is rotatably fitted on this eccentric rotary cam 38 via a connecting hole 39*a* having a metal bearing 40 provided at this end. The other end of the rod 39 on the side of the pad 3 is pivotally coupled with the input portion 22*c* provided by attaching the input shaft on the top face of the rear pad support member 22, whereby this end is pivotally coupled with the rear pad 3.

Each of the pair of upper and lower eccentric rotary cams 38 includes, as its rotation "axis", an outer peripheral cam face 38*a* formed of a peripheral face having a center 41 offset from the axis of the output shaft 4*a* of the electric motor 4, so that the pad operating rod 39 may be reciprocated along the front and rear direction of the machine frame by means of the outer peripheral cam face 38*a*. Further, the pair of eccentric rotary cams 38 are fixed to the motor output shaft 4*a* with a positional relationship that the center 41 of one cam 38 and the center 41 of the other cam 38 are located on a single straight line extending through the axis of the motor output shaft 4*a* and on the opposite sides across this axis of the output shaft 4*a*. With this, the pair of pad operating rods 39 are driven to be independently reciprocated by the pair of eccentric rotary cams 38, whereby the pair of pads 3 are reciprocated along the support rails 20 in the front and rear direction of the machine frame 10 and in the opposite directions from each other.

With the above-described construction, this pad operating mechanism 30 operates the two pads 3 by the drive force of the electric motor 4 in the manner described below.

First, the drive force of the electric motor 4 drives the pair of eccentric rotary cams 38 about the axis of the motor output shaft 4*a*. One eccentric rotary cam 38 reciprocates one pad operating rod 39, thereby to reciprocate the rear pad 3 along the support rail 20 in the front and rear direction of the machine frame 10. Further, the other eccentric cam 38 reciprocates the other pad operating rod 39, thereby to reciprocate the front pad 3 along the support rail 20 in the front and rear direction of the machine frame 10.

In the course of the above, the pair of eccentric rotary cams 38 reciprocates the pair of pad operating rods 39 with the above-described positional relationship. With this, the pair of pad operating rods 39 reciprocate the pair of pads 3 along the front and rear direction of the machine frame corresponding to the juxtaposing direction of these pads and in the opposite directions from each other so that the reaction forces acting on the two pads 3 from the floor surface may be effectively offset each other.

[Other Embodiments]

(1) In the foregoing embodiments, the pair of pads 3 are juxtaposed along the front and rear direction of the machine body 10. Instead, the present invention may be applied to a further construction in which these pads 3 are juxtaposed along the lateral direction of the machine body 10. The invention may be applied to a still further construction in which a plurality of pairs of pads 3 are juxtaposed along the front and rear or lateral direction of the machine frame 10.

(2) In the foregoing embodiments, the invention's apparatus is embodied as a hand-propelled electric-motored floor-surface polisher. The apparatus of the invention may also be embodied as a self-propelling and cleaning type apparatus including a machine frame self-propellant by drive wheels on the floor surface and including a cleaning device in addition to the pads 3 so that with simultaneous supply of cleaning liquid on to the floor surface, the pads 3 are operated to effect a polishing/cleaning operation on the floor surface and the used cleaning liquid is drawn into an exhaust liquid tank also mounted on the apparatus.

INDUSTRIAL APPLICABILITY

The electric-motored floor-surface polisher according to the present invention may be used for e.g. an operation for polishing/cleaning a floor surface by means of the pads driven by the electric motor.

The invention claimed is:

1. An electric-motored floor-surface polisher comprising:

a pair of pads juxtaposed in the front and rear or lateral direction of an apparatus frame, each pad being slidably supported to the apparatus frame;

a drive pulley coupled to an output shaft of an electric motor to be rotated therewith;

a pair of pad driving members, each pad driving member having an input pulley portion operably coupled with said drive pulley via a toothed belt and having also an output portion provided at a portion of the driving member offset from a rotational axis of the input pulley portion to be rotatable therewith; and a pair of pad operating rods, one of the pair of pad operating rods having one end thereof pivotally coupled with the output portion of one of the pair of pad driving members and the other end thereof pivotally coupled with the one of the pair of pads and the other pad operating rod having one end thereof pivotally coupled with the output portion of the other pad driving member and the other end thereof pivotally coupled with the other pad;

whereby the pair of pad operating rods slidably reciprocating the pair of pads along the juxtaposing direction thereof and in directions opposite to each other.

2. The polisher according to claim 1, wherein the pair of pad driving members are disposed, relative to the drive pulley, on a side opposite to or away from the side where the pads operatively coupled to the pad operating rods are located.

* * * * *